United States Patent [19]

Corliss et al.

[11] Patent Number: 4,794,907

[45] Date of Patent: Jan. 3, 1989

[54] GASEOUS FUEL RANGE

[75] Inventors: John M. Corliss; Earl W. Cox, both of Columbus, Ohio

[73] Assignee: Gas Research Institute, Chicago, Ill.

[21] Appl. No.: 80,419

[22] Filed: Jul. 31, 1987

[51] Int. Cl.[4] ..... F24C 3/00

[52] U.S. Cl. ..... 126/39 R; 431/354; 431/281

[58] Field of Search ..... 126/39 N, 39 A, 39 R, 126/15 A, 214 R; 431/90, 281, 279, 354

[56] References Cited

U.S. PATENT DOCUMENTS

| | | | |
|---|---|---|---|
| 1,076,857 | 10/1913 | Anderson | 431/354 |
| 1,654,658 | 1/1928 | McIlvaine | 431/354 X |
| 1,935,895 | 11/1933 | Tinnerman | 126/39 N |
| 2,139,643 | 12/1938 | Schneider | 126/39 R |
| 3,371,699 | 3/1968 | Riot | 431/354 X |
| 3,700,378 | 10/1972 | Scheid | 126/39 R X |
| 4,622,946 | 11/1986 | Hurley et al. | 126/39 R X |

*Primary Examiner*—Randall L. Green

*Attorney, Agent, or Firm*—Watkins, Dunbar & Pollick

[57] ABSTRACT

A fuelgas range is provided with multiple burners and control apparatus which assures flow of an ideal premixture of fuelgas and air to each burner over a wide range of flow values and independently of each other burner. The control apparatus includes an air blower, an air plenum, and valve means for introducing air to the range burners from the plenum and maintaining the pressure of air in the plenum at a constant value.

6 Claims, 2 Drawing Sheets

GASEOUS FUEL RANGE

TECHNICAL FIELD

This invention relates generally to combustion equipment, and particularly concerns apparatus providing a flow of an ideal pre-mixture of gaseous fuel and air to a cooking burner or burners in a kitchen range over a wide range of combustion rates.

BACKGROUND OF THE INVENTION

Ranges of the conventional type utilized in kitchens for cooking typically have one or more atmospheric burner assemblies that each receive a mixture of pressurized gaseous fuel (such as natural gas, manufactured gas, propane, etc.) and atmospheric air. Most of the air constituent is conventionally introduced into the burner or burners at its atmospheric pressure by induction through an air inlet opening that remains of constant size over a complete range of burner gaseous fuel flow rates. The remaining air is convected to the flame from under the burner in an uncontrolled manner and in great excess to the amount needed. Thus, the ideal ratio of air to gaseous fuel is not maintained uniformly over the burner's range of gaseous fuel flow rates and optimum combustion efficiency is not assured at all operational settings of the burner.

We have discovered that an optimum (maximum) combustion efficiency can be assured over a range of gaseous fuel flow rates by introducing air into the range burners at a constant pressure greater than atmospheric pressure, and simultaneously varying the size of the burner's air inlet opening as a function of gaseous fuel flow rate to provide an ideal air flow over a wide range of combustion rates.

SUMMARY OF THE INVENTION

To achieve the objects of our invention we provide a range with a gaseous fuel flow control valve and with an air plenum that receives combustion air from a source, such as a blower, at a constant pressure greater than atmospheric pressure. The plenum is provided with a first opening that vents to atmosphere, a second opening that registers and communicates with the range burner gaseous fuel air supply inlet, and a slide valve which cooperates with both plenum openings so that the total area of the two plenum openings remains constant as the slide valve is moved throughout its range of operating positions. The plenum slide valve cooperates with range gaseous fuel flow control valve means and is moved in a first direction as the gaseous fuel flow control valve is moved in an increased flow direction and is moved in a second (opposite) direction when the gaseous fuel flow control valve is moved in a reduced flow direction. The plenum openings, slide valve, and gaseous fuel flow control valve are designed and positioned so that the ratio of air to gaseous fuel flow through the burner is maintained at a constant optimum value as the gaseous fuel control valve is moved throughout its range of operational settings.

DETAILED DESCRIPTION

Figure 1:
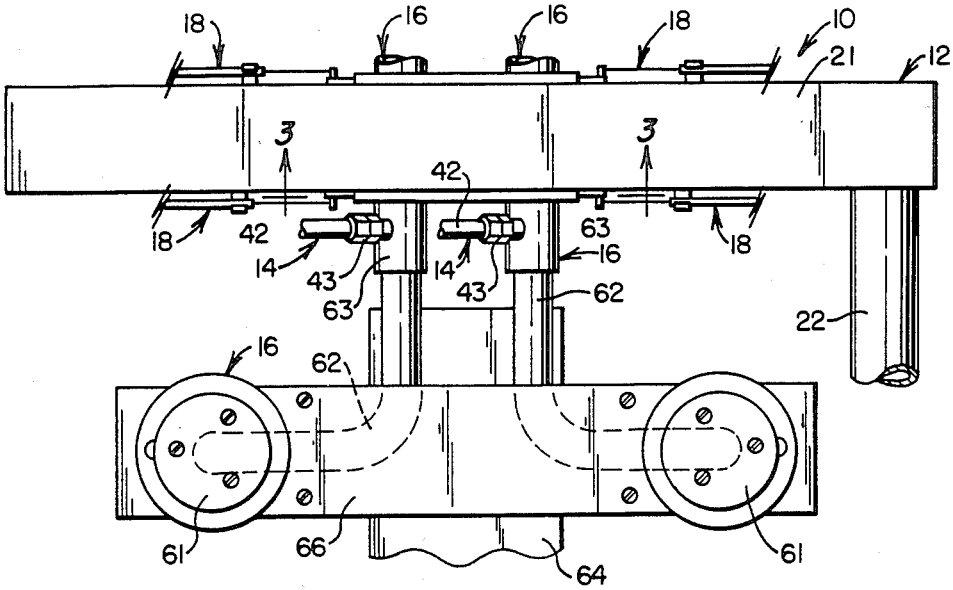
FIG. 1 is a schematic plan view of a portion of a kitchen range incorporating a preferred embodiment of the instant invention.

A preferred embodiment of a power range is partially illustrated in FIG. 1 of the drawings. Such apparatus is referenced generally as 10 and is comprised of a pressurized air supply 12, a gaseous fuel supply 14, burner assemblies 16, and a control system 18 for regulating the delivery of gaseous fuel and pressurized air to the burner assemblies.

Pressurized air supply 12 is comprised of a plenum box 21 and a air duct 22 which delivers pressurized air from a source such as a blower (not shown) to the plenum box. Plenum box 21 has a pair of openings 23, 24 for each burner assembly. Openign 23 is an atmospheric opening and opening 24 is provided in the plenum box so that it registers with the gaseous fuel air inlet of each burner assembly.

Gaseous fuel for range apparatus 10, which may be natural gas, manufactured gas, propane, or the like at a pressure greater than atmospheric pressure is basically obtained from a gaseous fuel supply line 41 and after metering by the hereinafter described flow control valve is delivered by gaseous fuel line 42 to a fitting 43 which cooperates with each the applicable burner assembly gaseous fuel air supply inlet.

Figure 2:
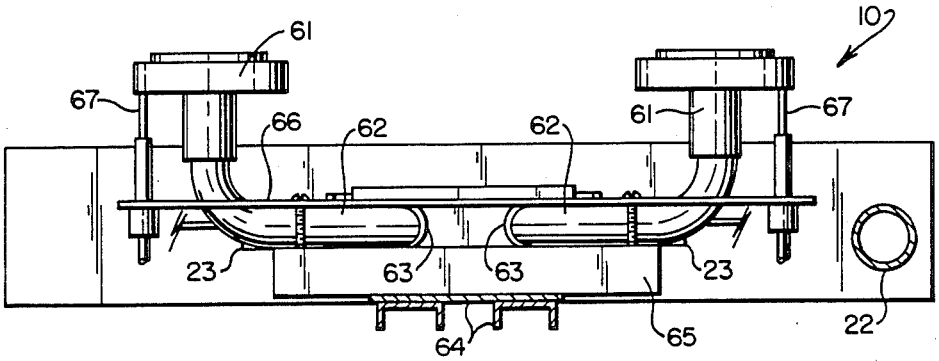
FIG. 2 is an elevation view of the apparatus of FIG. 1.
Figure 3:
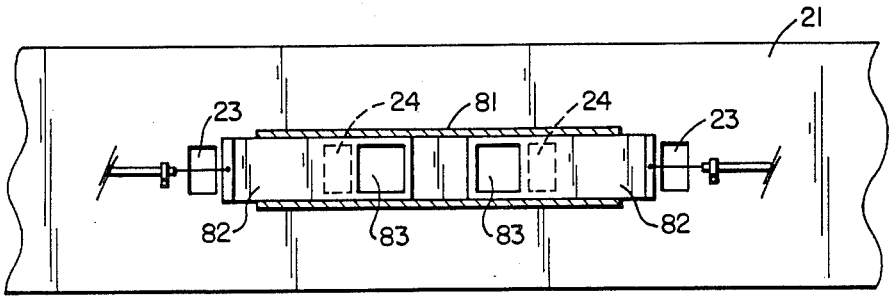
FIG. 3 is an enlarged sectional view taken at line 3—3 of FIG. 1.

As best shown in FIGS. 1 and 2 of the drawings, each burner assembly 16 is comprised of a burner head 61, a burner pipe 62 connected to the head, and a burner assembly gaseous fuel air supply inlet sleeve 63 connected to burner pipe 62 and also to the herinafter described flow control valve bracket. Structural elements 64, 65, and 66 are provided to support the burner assemblies in their operating position. Also, electrical ignition elements 67 are provided in apparatus 10 and are of conventional design. Such ignition elements do not comprise a part of the present invention. Also, grates (not shown) are normally provided in the range to support utilized cooking utensils. Such grates normally are positioned above and in surrounding relation to the different burner assemblies.

Figure 4:
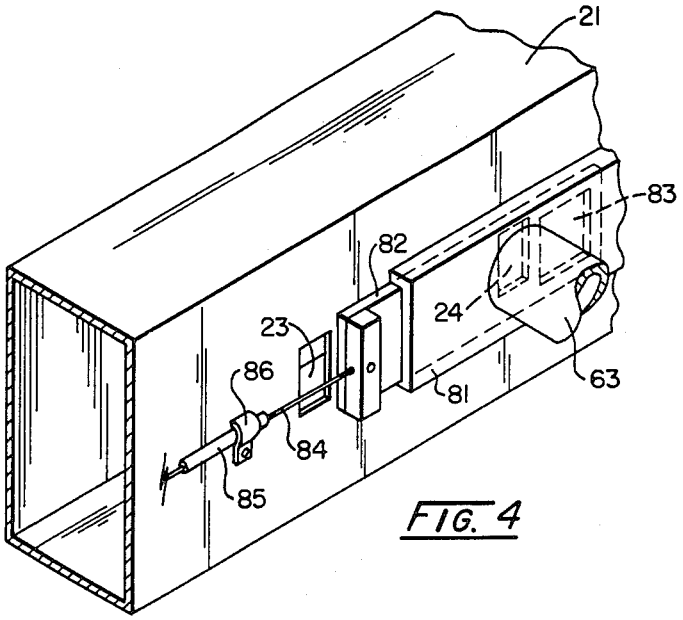
FIG. 4 is an enlarged perspective view of a portion of the apparatus of FIG. 1.
Figure 5:
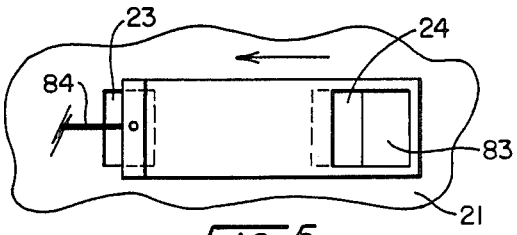
FIG. 5 is an elevational view of the apparatus slide valve element in another operating position.

The control system 18 of the instant invention includes bracket 81, which is a shallow, U-shaped bracket secured to plenum box 32 (FIG. 4), and slide valves 82 which cooperate with and are contained by the bracket. Each slide valve has an opening 83 for controlling the flow of air from pressurized plenum box 21, through opening 24, and into the associated burner gaseous fuel air inlet sleeve 63. The control system is also comprised of push/pull cables 84 which slide within flexible cable housings 85 and which are secured in place by the clips 86 that cooperate with the cable housing and the plenum wall or other range structure.

Figure 6:
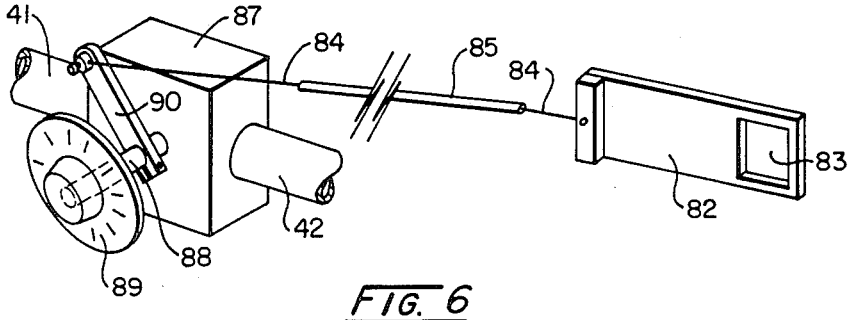
FIG. 6 is a schematic perspective view of the gaseous fuel flow control valve and plenum slide valve elements of the invention in their cooperating relation to each other.

As schematically illustrated in FIG. 6, control system 18 is further comprised of a conventional gaseous fuel control valve 87, a valve shaft 88 connected to the valve, and a manual control knob 89 connected to the valve shaft. A lever arm 90 is also connected to the valve shaft and functions, when control knob 89 is turned, to move push/pull cable 84. One end of cable 84 is connected to the end lever arm 90 and the other end of the push/pull cable is connected to slide valve 82.

During operation of range 10, pressurized air is supplied to the interior of plenum box 21 by air supply duct 22 and is maintained at a constant pressure above atmospheric pressure but below the pressure of the gaseous fuel delivered through lines 41 and 42 to gaseous fuel air inlet sleeve 63. The air supplied is maintained at a constant pressure by the action of the slide valves 82 cooperating with the openings 23 and 24 in the plenum box. Each slide valve member 82 functions to maintain an ideal gaseous fuel to air ratio at all positions of control knob 89 as slide valve 82 and gaseous fuel flow control valve 87 are moved throughout their entire operating range. The ideal ratio is the minimum air to gaseous fuel ratio associated with 100% combustion efficiency while maintaining low carbon monoxide emissions. Any additional air beyond this amount results in a lower combustion efficiency. By the coordinated action of openings 23 and 24 being opened or closed by slide valve 82, the desired operating pressure within the plenum box 21 is also maintained at a constant value. In this manner the flow rate of air through openings 24 is modulated with a variable size opening and essentially as a linear function of gaseous fuel flow rate.

The described range 10 functions to permit the operation of multiple burners at independent settings with out adversely influencing the performance of each other. Also, the system allows the operation of multiple burners with only one system blower or fun for meeting combustion air requirements.

Although a preferred embodiment of the invention has been herein described, it will be understood that various changes and modifications in the illustrated and described structure can be affected without departure from the basic principles that underlie the invention. Changes and modifications of this type can therefore deem to be circumscribed by the spirit and scope of the invention, except as the same may be necessarily modified by the appended claims or reasonable equivalence thereof.

We claim:

1. A range which utilizes a pre-mixture of gaseous fuel and air, comprising in combination:

a. burner gaseous fuel/air inlet means;

b. plenum means receiving combustion air at a pressure greater than atmospheric pressure;

c. first outlet means in said plenum means and vented to the atmosphere;

d. second outlet means in said plenum means and positioned in registration with said burner gaseous fuel/air inlet means; and e. valve means cooperating with said first and second outlet means, said valve means closing said first outlet means and opening said second outlet means when actuated in one direction, and opening said first outlet means and closing said second outlet means when actuated in an opposite direction whereby air in said plenum means is both vented to the atmosphere through said first outlet means and directed to said gaseous fuel/air inlet means in proportion to the position of said valve means.

2. The invention defined by claim 1 and further comprising a variable gaseous fuel flow control means, said valve means being coupled to said gaseous fuel flow control means in cooperating relation whereby increasing the flow of gaseous fuel by said gaseous fuel flow control causes said valve to move in said one direction, and decreasing the flow of gaseous fuel by said fuelgas flow control means causes said valve means to move in said opposite direction.

3. The invention defined by claim 2 further comprised of flexible push/pull cable means, said push/pull cable means being connected at its extremes to said gaseous fuel flow control means and to said valve means.

4. The invention defined by claim 1 wherein said valve means comprises a slide member.

5. A range having multiple burners which utilize a pre-mixture of gaseous fuel and air, comprising in combination:

a. plenum means having multiple vent outlets and multiple burner outlets;

b. a blower means providing air to said plenum means at a pressure greater than atmospheric pressure;

c. said multiple burners having a gaseous fuel/air inlet means in registration with said plenum multiple burner outlets, respectively; and d. valve means for each burner cooperating with a respective vent outlet and burner outlet for each burner for closing said vent outlet and opening said burner outlet for each respective burner when actuated in one direction and opening said vent outlet and closing said burner outlet when actuated in an opposite direction such that the pressure of air in said plenum means is maintained constant as said valve means are operated over a range of different settings.

6. The invention defined by claim 5 further comprising multiple gaseous fuel flow control means, said gaseous fuel flow control means causing actuation of a respective valve means as said multiple gaseous fuel flow control means are operated over a range of independent settings.

* * * * *